US005336144A

United States Patent [19]

Rodden

[11] Patent Number: 5,336,144

[45] Date of Patent: Aug. 9, 1994

[54] TREADMILL WITH ELASTOMERIC-SPRING MOUNTED DECK

[75] Inventor: Patrick T. Rodden, Snohomish, Wash.

[73] Assignee: Precor Incorporated, Bothell, Wash.

[21] Appl. No.: 972,009

[22] Filed: Nov. 5, 1992

[51] Int. Cl.[5] ..... A63B 22/02

[52] U.S. Cl. ..... 482/54; 482/51

[58] Field of Search ..... 482/54, 79, 77, 51

[56] References Cited

U.S. PATENT DOCUMENTS

| | | | |
|---|---|---|---|
| 3,427,019 | 2/1969 | Brown | 482/77 |
| 3,689,066 | 9/1972 | Hagen . | |
| 4,334,676 | 6/1982 | Schonenberger . | |
| 4,350,336 | 9/1982 | Hanford . | |
| 4,614,337 | 9/1986 | Schonenberger . | |
| 4,819,583 | 4/1989 | Guerra | 482/54 |
| 4,886,266 | 12/1989 | Trulaske . | |
| 4,974,831 | 12/1990 | Dunham . | |
| 5,081,991 | 1/1992 | Chance . | |
| 5,100,127 | 3/1992 | Melnick et al. . | |

FOREIGN PATENT DOCUMENTS

| | | |
|---|---|---|
| 196877 | 10/1986 | European Pat. Off. . |
| 0504649A1 | 9/1992 | European Pat. Off. . |
| 4003871 | 8/1991 | Fed. Rep. of Germany . |
| 2616132 | 12/1988 | France . |
| 1567221 | 5/1990 | U.S.S.R. . |
| 2153825 | 1/1985 | United Kingdom . |

*Primary Examiner*—Richard J. Apley
*Assistant Examiner*—Lynne A. Reichard
*Attorney, Agent, or Firm*—Christensen, O'Connor, Johnson & Kindness

[57] ABSTRACT

A treadmill (10) includes a frame (12) on which are rotatably mounted first and second transverse roller assemblies (14, 16). An endless belt (18) is trained about the roller assemblies. A deck (20) is disposed between an upper run of the belt and the frame. The deck is supported spaced from the frame by a plurality of cup-shaped elastomeric springs (22). The elastomeric springs reversibly deform upon downward deflection of the deck toward the frame. Each elastomeric spring (22) has a sidewall (50) tapering in thickness. The resistance to the downward travel of the deck provided by the elastomeric springs is proportional to the degree of deflection of the deck toward the frame.

20 Claims, 3 Drawing Sheets

TREADMILL WITH ELASTOMERIC-SPRING MOUNTED DECK

TECHNICAL FIELD OF THE INVENTION

The present invention relates to exercise equipment, more particularly to exercise treadmills, and still more particularly to exercise treadmills having a deck supported above a frame by elastomeric mounting members.

BACKGROUND OF THE INVENTION

Treadmills have become popular in recent years for both home and office use to enable exercisers to run indoors in small confines. Most exercise treadmills include first and second roller assemblies that are rotatably mounted across opposite ends of a frame. An endless belt is trained about the roller assemblies. The upper run of the belt is supported by a slider deck disposed between the frame and the upper run of the belt. In order to cushion the impact of an exerciser's feet on the treadmill belt, the slider deck on many conventional treadmills is mounted on the frame using a shock absorbing mechanism.

One method of mounting a treadmill deck to reduce impact on an exerciser's feet, ankles and legs is disclosed by U.S. Pat. No. 4,974,831 to Dunham. The treadmill disclosed therein has a deck that is pivotally mounted at one end to the frame, with the other end of the deck being supported by a suspension system utilizing lever arms. Each lever arm is pivotally connected at one end to the deck, and at the lever arm's midpoint to the frame. Shock absorbers are interconnected between the opposite end of each lever arm and the frame. Striding on the deck results in pivoting of the lever arms and extension of the shock absorbers to dampen the impact of the exerciser's feet. While this shock absorption system is very successful, it is complex and therefore costly to manufacture.

Other conventional treadmills have utilized rubber blocks placed between the deck and the frame to absorb impact. One such conventional treadmill is disclosed in French Patent No. 2,616,132. A treadmill deck is mounted above treadmill frame members on a plurality of flexible pads. Bushings are inserted into the top and bottom of each pad, and bolts depending downwardly from the deck and upwardly from the frame are received within corresponding bushings. The bolts serve to position the flexible pads between the deck and the frame for shock absorption.

While the treadmill disclosed by French Patent No. 2,616,132 is less complex than the above-described lever and shock absorber mechanical suspension system, it does not perform equivalently for exercisers of differing weights. Flexible pads that are sufficiently small to deform under the impact of an exerciser of low weight would be insufficient to absorb the impact resulting from exercise by a larger person. Similarly, if flexible pads of sufficient size and stiffness are used to adequately cushion and protect a larger exerciser, the flexible pads would not compress sufficiently under the weight of a smaller exerciser and therefore would provide insufficient shock absorption for such smaller exercisers.

An additional drawback of the treadmill disclosed by French Patent No. 2,616,132 is that the flexible pads, as mounted between opposing studs, are capable of deforming in a manner that would allow the treadmill deck to move forward and aft or side-to-side relative to the treadmill frame during impact. To partially overcome this drawback, the French patent includes a flexible stopper secured to a bracket depending downwardly from the underside of the deck that bears against a member of the frame. While this construction would serve to limit forward movement of the deck relative to the frame, no provision is provided for preventing undesirable side-to-side motion of the deck relative to the frame. Additionally, inclusion of the two opposing bolts to mount each flexible pad and the need to include a separate stop assembly raises the complexity of assembly and cost of the treadmill.

SUMMARY OF THE INVENTION

The present invention provides an exercise treadmill including a frame, first and second roller assemblies rotatably mounted on the frame, and an endless belt trained about the first and second roller assemblies. The exercise treadmill also includes a deck disposed between the frame and an upper run of the belt. Elastomeric spring members are disposed between the deck and the frame for supporting the deck spaced apart from the frame. The elastomeric spring members reversibly deform to resist deflection of the deck toward the frame when an exerciser strides on the belt, with the resistance provided by the elastomeric spring members being proportional to the extent of deflection of the deck.

In a further aspect of the present invention, the elastomeric spring members are configured as cup-shaped elastomeric springs that reversibly deform to resist deflection of the deck and absorb the shock of the exerciser's impact. In a preferred embodiment, each cup-shaped elastomeric spring has a cylindrical sidewall that tapers in width in a direction perpendicular to a plane defined by the deck. Upon deflection of the deck, the springs compress axially. The tapered, cylindrical sidewall provides for variable resistance to compression of the elastomeric spring, so that the resistance to deflection of the deck toward the frame increases with increasing deflection of the deck.

The present invention thus provides a treadmill deck that is easily deflected by light-weight exercisers, this deflection being resisted by compression of the tapered upper extremity of the sidewall of each elastomeric spring. The treadmill also functions well for larger exercisers, with the larger impact loads resulting therefrom being absorbed and resisted by further compression of the increasingly thick elastomeric springs.

In this preferred embodiment the deck is supported only by the elastomeric springs. The deck is free to "float" toward and away from the frame during use, with resistance to this floating being provided by compression of the elastomeric springs. To prevent undesirable forward and aft or side-to-side motion of the deck relative to the frame, the deck includes studs that depend downwardly from the deck and pass through central apertures formed in the elastomeric springs. The depending end of the studs are then slidably received within apertures formed in the frame therebelow. The studs serve to prevent movement of the deck relative to the frame in directions along the plane defined by the deck, while not limiting deflection of the deck toward the frame.

The exercise treadmill of the present invention thus provides for shock absorption and prevention of potential shock-related injury for exercisers of varying sizes and weights, and provides a running surface that does not shift laterally or forward and aft under the exerciser's feet. At the same time the treadmill of the present invention is lower in cost to manufacture and assemble than conventional treadmills.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
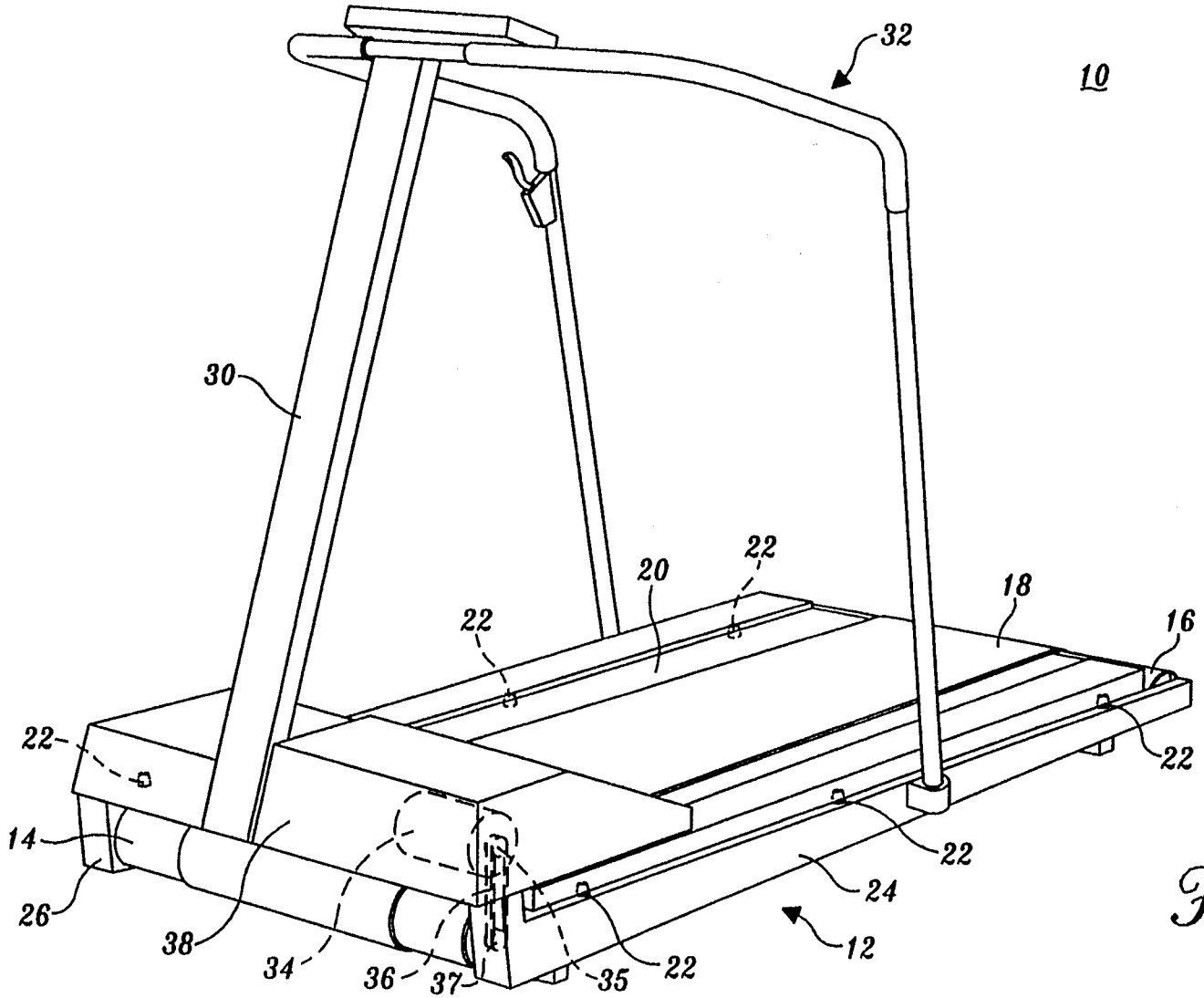
FIG. 1 provides a pictorial view of an exercise treadmill constructed in accordance with the present invention.

A treadmill 10 constructed in accordance with the present invention is shown in FIG. 1. The treadmill 10 includes a frame 12 on opposite sides of which are transversely mounted a forward roller assembly 14 and a rear roller assembly 16. An endless belt 18 is trained about the forward roller assembly 14 and the rear roller assembly 16. A deck 20 is disposed between the upper run of the belt 18 and the frame 12. The deck 20 is supported by a plurality of upwardly opening, cup-shaped elastomeric springs 22 disposed between the deck 20 and the frame 12.

Figure 2:
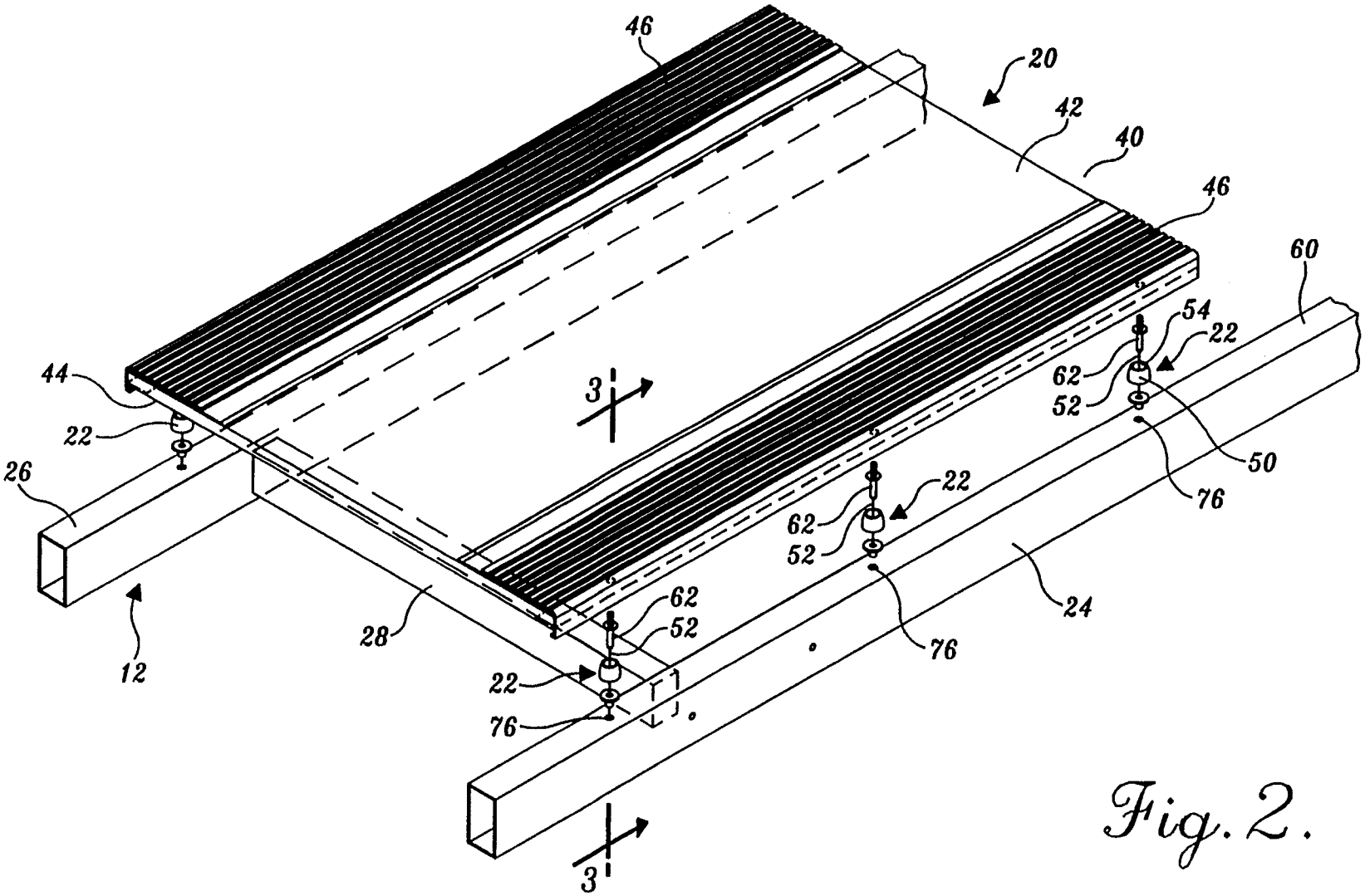
FIG. 2 provides an exploded pictorial view of the frame, deck, elastomeric springs and mounting hardware of the exercise treadmill of FIG. 1.

Referring to FIGS. 1 and 2, the frame 12 includes first and second longitudinal siderail members 24 and 26. The siderail members 24 and 26 are spaced apart in parallel relationship and secured together by transverse cross members 28 (only one of which is shown in FIG. 2). The siderail members 24 and 26 are preferably formed from hollow metal extrusions.

An upright member 30 projecting upwardly from the forward end of the frame 12 supports the center of a contoured railing 32 that is graspable by an exerciser running on the treadmill (FIG. 1). The railing 32 extends downwardly on either side from the upright member 30, terminating at and secured to the siderail members 24 and 26.

The treadmill 10 further includes a motor 34 having a drive shaft 35 engaged by a drive belt 36 to a pulley 37 mounted on one end of the forward roller assembly 14. As used herein throughout, "forward" refers to the direction in which an exerciser faces when using the treadmill. The terms "rear" and "rearward" refer to the opposite direction. The motor 34 is housed within a cover 38. The motor 34 drives rotation of the forward roller assembly 14, thus causing movement of the treadmill belt 18 on which an exerciser strides during use of the treadmill 10.

Referring to FIG. 2, the deck 20 is formed from a flat, substantially rigid sheet 40 having an upper surface 42 and a lower surface 44. Suitable materials for the sheet 40 include plywood, reinforced thermoset plastic materials, metal, and other substantially rigid materials. Preferably, the upper surface 42 of the sheet 40 has a low-friction coating applied thereto. Elongate "U"-shaped belt-guide moldings 46 are installed on each long edge of the sheet 40, wrapping an edge portion of the upper surface 42 and an edge portion of the lower surface 44 proximate to each edge of the sheet 40.

Referring to both FIGS. 1 and 2, the width of the deck 20 is approximately equal to the width of the frame 12. A plurality of elastomeric springs 22 are disposed at spaced intervals on top of each of the frame siderail members 24 and 26, thereby supporting the deck 20 spaced apart from and above the frame 12. In the preferred embodiment illustrated, three elastomeric springs 22 are spaced at even intervals along the length of each siderail member 24 and 26. However, it should be readily apparent to those of ordinary skill in the art that a greater or lesser number of elastomeric springs 22 may be utilized to provide for greater or lesser resistance to downward travel of the deck 20.

The formation of the elastomeric springs 22, each of which are identically constructed, shall now be described while referring to FIGS. 2 and 3. Each elastomeric spring 22 has a cup-shaped configuration, and includes a circular flat bottom portion 48 and a sidewall portion 50 projecting upwardly and generally perpendicularly from the outer circumference of the bottom portion 48. The sidewall portion 50 thus has a cylindrical configuration, and is formed about a central axis 52. The sidewall portion 50 and bottom portion 48 define an internal cavity 54 that opens through an aperture 56 defined by the extreme upper edge 58 of the sidewall portion 50.

Figure 3:
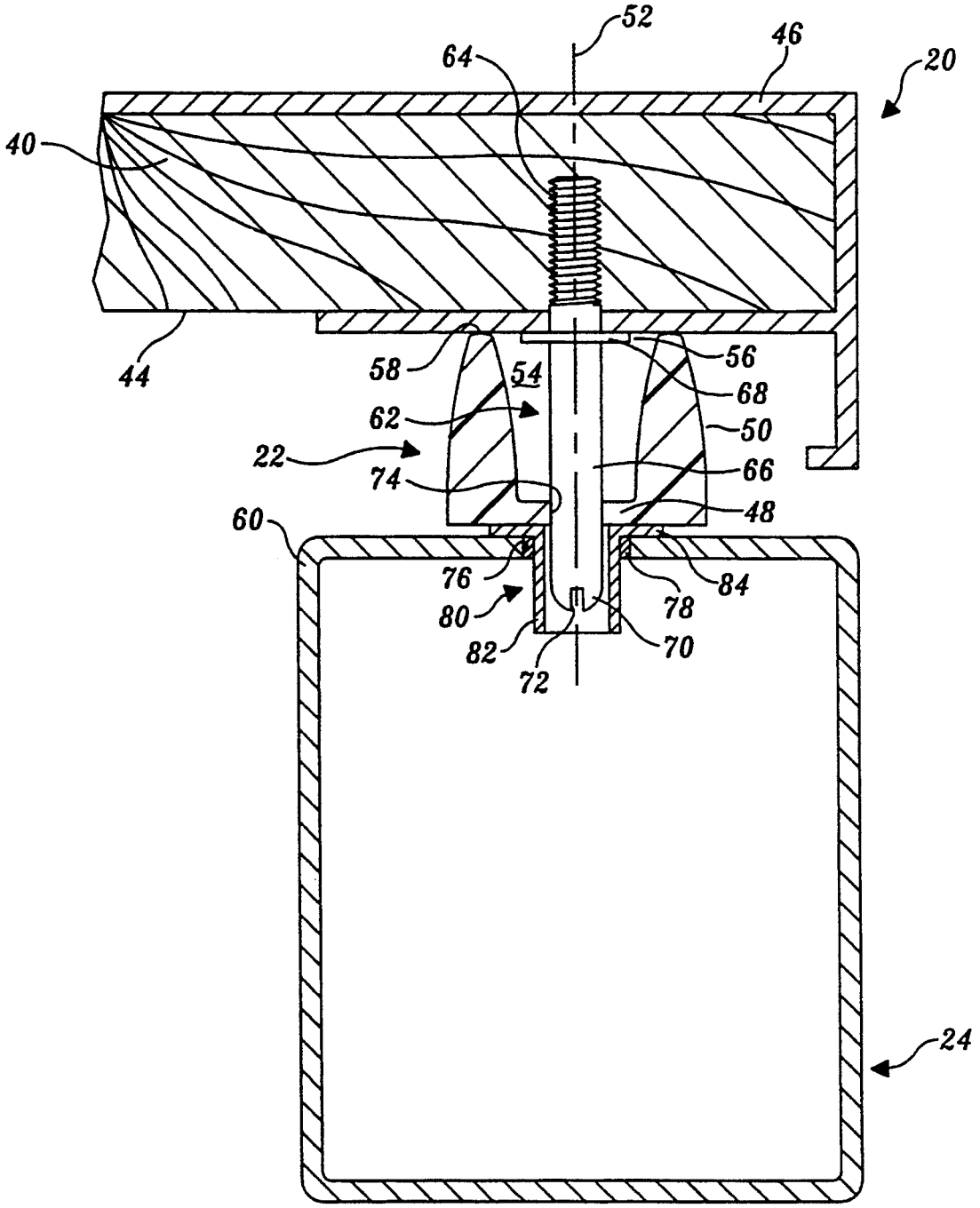
FIG. 3 provides a cross-sectional detailed view of an elastomeric spring installed in the treadmill of FIG. 1, taken substantially along line 3—3 of FIG. 2.

Referring to FIG. 3, the cross-sectional width of the sidewall portion 50 tapers upwardly in the direction moving away from the bottom portion 48 along the height of the elastomeric spring 22. Both the inner surface defining the cavity 54 and the outer surface of the sidewall portion 50 are tapered, such that the sidewall portion 50 has a generally frustoconical contour when viewed in a cross section taken along a plane in which the central axis 52 of the elastomeric spring 22 lies. Each elastomeric spring 22 is formed from a reversibly deformable synthetic or natural elastomeric material. One suitable material is a natural rubber having a hardness of 60 durometer shore A. Other suitable materials include nitrile or polychloroprene rubbers.

In the preferred embodiment, each of the elastomeric springs 22 is installed with the bottom portion 48 thereof resting on the top side 60 of the corresponding siderail member 24 or 26. The central axis 52 of the elastomeric spring 22 is thus oriented substantially orthogonally to a plane defined by the deck 20. When so installed, the cavity 54 opens upwardly, and the circular upper edge 58 of the spring 22 contacts the underside of the deck 20.

In order to retain the elastomeric springs 22 in the desired position, as well as to prevent substantial forward and aft or side-to-side motion of the deck 20 relative to the frame 12 along a plane defined by the deck 20, the deck 20 includes a plurality of studs 62 in a quantity matching the number of elastomeric springs 22. Referring to FIG. 3, each stud 62 includes an upper threaded portion 64 and a lower non-threaded portion 66. An annular flange 68 is formed on the stud 62 between the upper threaded portion 64 and the lower non-threaded portion 66. The upper threaded portion 64 of each stud 62 is threaded into the lower surface 44 of the sheet 40 until the flange 68 bears against the underside of the deck 20. The non-threaded portion 66 of the stud 62 thus projects substantially orthogonally downward from the underside of the deck 20. A distal tip 70 of the non-threaded portion 66 of the stud 62 has a convex shape. A slot 72 is formed crosswise against the tip 70 to allow for screwdriver installation of the studs 62 into the deck 20.

Referring to FIG. 3, a central aperture 74 centered on the central axis 52 is formed through the bottom portion 48 of each elastomeric spring 22. A plurality of longitudinally spaced apertures 76 are also formed through the top side 60 of each frame siderail member 24 and 26 at locations corresponding to the positioning of the elastomeric springs 22 (FIG. 2). An elastomeric grommet 78 is preferably installed within each aperture 76, as shown in FIG. 3. A cylindrical bushing 80 having a tubular sleeve portion 82 and an annular flange portion 84 is installed within each aperture 76, the sleeve portion 82 being received within the grommet 78 and the annular flange portion 84 resting on the exterior of the top side 60 of each frame siderail member 24 or 26. As shown in FIG. 3, the internal diameter of the sleeve portion 82 of each bushing 80 is slightly larger than the external diameter of the lower non-threaded portion 66 of each stud 62. The bushings 80 are preferably formed from a rigid, low-friction material, such as a polyamide plastic.

The treadmill 10 is assembled by sliding an elastomeric spring 22 axially onto the lower non-threaded portion 66 of each stud 62. The cavity 54 of each elastomeric spring 22 faces upwardly toward the deck 20, with the lower non-threaded portion 66 of the stud 62 passing through the central aperture 74 of the elastomeric spring 22. After the elastomeric springs 22 are mounted on the studs 62, the deck 20 is simply placed on top of the frame 12, with the projecting ends of the studs 62 sliding into the corresponding bushings 80.

The clearance provided between the studs 62 and the bushings 80, due to the oversized internal diameter of the bushings 80, allows for tolerance variations in placement of the studs 62. Additionally, when the deck 20 is deflected by an exerciser running on the treadmill belt 18, the clearance between the studs 62 and the bushings 80 enables the deck 20 to tilt slightly out of a plane parallel to the frame 12. Further accommodation for tolerance variations and slight tilting of the deck 20 is provided by the elastomeric grommets 78 installed between the bushings 80 and the frame siderail members 24 and 26.

As shown in FIGS. 1–3, the deck 20 of the treadmill 10 is not rigidly connected to the frame 12 in any fashion, being supported above the frame 12 only by the elastomeric springs 22. The studs 62 act as guide members to prevent undesirable movement of the deck 20 in the forward and aft and side-to-side directions, but do not provide a rigid interconnection between the deck 20 and frame 12. When an exerciser treads on the belt 18 of the treadmill 10, the deck 20 is deflected downwardly toward the frame 12, this deflection being resisted by compression of the elastomeric springs 22. The elastomeric springs 22 act to absorb the shock of the impact of the exerciser's feet. Because the treadmill deck 20 is mounted only on the elastomeric springs 22, the treadmill deck 20 is free to "float" up and down relative to the frame 12.

Downward deflection of the deck 20 toward the frame 12 results in a reversible, axial compression of the elastomeric springs 22, causing the sidewall portion 50 of each elastomeric spring 22 to increase in thickness. Because of the tapered configuration of the sidewall portion 50, initial compression of the elastomeric springs 22 meets with a low level of resistance. The thin upper extremity of the sidewall portion 50 proximate the upper edge 58 of each elastomeric spring 22 compresses first. As the deck 20 continues to travel toward the frame 12, an increasingly thicker section of the tubular sidewall portion 50 must be compressed. The elastomeric springs 22 thus become increasingly "stiff" with further compression, offering a degree of resistance to downward movement of the deck 20 that increases in proportion to the extent of downward travel of the deck 20.

After axial compression of the spring 22, in case of large impacts, the sidewall portion 50 of the elastomeric springs 20 will "cave in," or buckle. This reversible collapsing of the sidewall portion 50 provides an even greater resistance and shock absorption against extreme downward travel of the deck 20. After each impact of an exerciser on the treadmill deck 20, the elastomeric springs 22 rapidly return to their initial configuration before the next footfall.

Because the degree of resistance to travel of the deck 20 provided by the springs 22 is proportional to the extent of deflection of the deck 20, the treadmill 10 provides suitable shock absorption for exercisers of varied weight. Individuals who are lighter in weight do not deliver as great an impact load to the treadmill deck 20. Nonetheless, the treadmill deck 20 deflects toward the treadmill frame 12 because of the relatively easy initial compression of the elastomeric springs 22, thereby providing adequate shock absorption for lightweight individuals. When an individual of greater weight uses the treadmill 10, greater impacts are delivered to the treadmill deck 20, which are met with a proportionately greater resistance by the elastomeric springs 22 because of the proportionally greater downward deflection of the deck 20.

While the present invention has been described above in terms of a preferred embodiment of a treadmill 10, it will be obvious to those of ordinary skill in the art that various modifications can be made, based on the disclosure contained herein, to the described embodiment. For example, rather than including studs 62 that depend downwardly from the deck 20, the studs 62 could instead project upwardly from the frame siderail members 24 and 26, with the upper ends of the studs being received within bushings mounted in the underside of the deck 20.

Instead of utilizing the studs 62, guide plates could be installed on the outer edges of the deck 20 and extend sufficiently downward to overlap the sides of the frame siderail members 24 and 26 to prevent forward and aft and side-to-side motion of the deck. The bottom portions 48 of the elastomeric springs 22 would then be secured to the frame siderail members 24 and 26 using screws or another securement method to prevent mislocation of the elastomeric springs during use.

While the present invention has been described thus far in terms of treadmills, it should be apparent that the cup-shaped elastomeric springs 22 of the present invention would be useful in supporting and providing shock absorption for the platforms of other exercise apparatus. For example, a bounce-board exerciser (not shown) could have an upper platform or deck supported above a frame or the floor by a plurality of elastomeric springs 22.

The present invention has been described above in terms of a preferred embodiment and several variations thereof, but other modifications, alterations and substitutions are possible within the scope of the present invention. It is thus intended that the scope of Letters Patent granted hereon be limited only by the definitions of the appended claims.

The embodiments of the invention in which an exclusive property or privilege is claimed are defined as follows:

1. An exercise treadmill comprising:
(a) a frame;
(b) first and second roller assemblies rotatably mounted on the frame;
(c) an endless belt trained about the first and second roller assemblies;
(d) a substantially rigid deck disposed between the frame and an upper run of the belt; and
(e) a plurality of elastomeric springs, each including a base portion and a sidewall portion projecting from the base portion to form an internal cavity that opens away from the base portion to define an aperture, the elastomeric springs being supported by the frame and underlying the substantially rigid deck to support the deck spaced apart from the frame, wherein the elastomeric springs reversibly deform to resist deflection of the deck toward the frame resulting from loads imposed by an exerciser on the belt, and wherein the substantially rigid deck distributes impact loads to substantially all of the elastomeric springs.

2. The exercise treadmill of claim 1, wherein the sidewall portion of each elastomeric spring is cylindrical and is formed about a central axis that is oriented substantially orthogonally to a plane defined by the deck.

3. The exercise treadmill of claim 1, wherein the sidewall portion of each elastomeric spring is formed about a central axis and tapers in thickness toward the aperture defined by the sidewall portion.

4. The exercise treadmill of claim 3, wherein the elastomeric springs compress axially in a direction parallel to the central axis upon deflection of the deck toward the frame.

5. The exercise treadmill of claim 1, wherein the elastomeric springs are formed to provide resistance to deflection of the deck toward the frame proportional to the extent of deflection of the deck.

6. The exercise treadmill of claim 1, wherein the sidewall portion of each elastomeric spring tapers in width in a direction substantially orthogonal to a plane defined by the deck.

7. The exercise treadmill of claim 1, wherein the deck is supported above the frame only by the elastomeric springs.

8. The exercise treadmill of claim 7, further comprising guide means formed on one of the deck or frame for preventing substantial movement of the deck relative to the frame in a direction substantially parallel to a plane defined by the deck.

9. The exercise treadmill of claim 8, wherein the guide means comprise a plurality of studs projecting outwardly from the deck in a direction toward the frame, wherein each stud passes through a second aperture formed centrally in the base portion of a corresponding elastomeric spring and is slidably received within a corresponding aperture formed in the frame.

10. An exercise treadmill comprising:
(a) a frame;
(b) first and second roller assemblies rotatably mounted on the frame;
(c) an endless belt trained about the first and second roller assemblies;
(d) a deck disposed between the frame and an upper run of the belt;
(e) elastomeric spring means disposed between the deck and the frame for mounting the deck on the frame, the elastomeric spring means reversibly deforming to resist deflection of the deck toward the frame when an exerciser strides on the belt, wherein the elastomeric spring means is formed to provide resistance proportional to the extent of deflection of the deck; and
(f) at least one engaging projection projecting outwardly from one of the deck or frame to be slidably received within an aperture formed in the other of the deck or frame, passing through an aperture formed in the elastomeric spring means therebetween.

11. The exercise treadmill of claim 10, wherein the elastomeric spring means comprises an elastomeric member that tapers in a direction substantially perpendicular to a plane defined by the deck.

12. The exercise treadmill of claim 10, wherein the elastomeric spring means comprises a hollow elastomeric member.

13. The exercise treadmill of claim 12, wherein the elastomeric member has a cylindrical sidewall portion.

14. The exercise treadmill of claim 12, wherein the sidewall portion of the elastomeric member is tapered in width.

15. The exercise treadmill of claim 14, wherein the deck is supported above the frame only by the elastomeric member.

16. The exercise treadmill of claim 10, wherein the deck is supported above the frame only by the elastomeric spring means.

17. The exercise treadmill of claim 16, further comprising guide means formed on one of the deck or frame for preventing substantial movement of the deck relative to the frame in a direction substantially parallel to a plane defined by the deck.

18. An exercise treadmill comprising:
(a) a frame;
(b) first and second roller assemblies rotatably mounted on the frame;
(c) an endless belt trained about the first and second roller assemblies;
(d) a deck disposed between the frame and an upper run of the belt;
(e) elastomeric spring means disposed between the deck and the frame for mounting the deck on the frame, the elastomeric spring means reversibly deforming to resist deflection of the deck toward the frame when an exerciser strides on the belt, wherein the elastomeric spring means is formed to provide resistance proportional to the extent of deflection of the deck and the deck is supported above the frame only by the elastomeric spring means; and
(f) guide means formed on one of the deck or frame for preventing substantial movement of the deck relative to the frame in a direction substantially parallel to a plane defined by the deck wherein the guide means comprise a plurality of studs projecting outwardly from the deck in a direction toward the frame, wherein each stud passes through an aperture formed centrally in a corresponding elastomeric spring means and is slidably received within a corresponding aperture formed in the frame.

19. An exercise apparatus mountable on a support surface, comprising:

(a) a substantially rigid platform for supporting the weight of an exerciser;

(b) a plurality of elastomeric springs, each including a base portion and a sidewall portion projecting from the base portion to form an internal cavity that opens away from the base portion to define an aperture; and (c) means mounting the elastomeric springs on the support surface and underlying the substantially rigid platform, wherein the elastomeric springs reversibly deform to resist deflection of the platform toward the support surface when an exerciser applies impact loads on the platform, and wherein the substantially rigid platform distributes impact loads to substantially all of the elastomeric springs.

20. The exercise apparatus of claim 19, wherein the sidewall portion of each elastomeric spring tapers in width.

* * * * *